US005460157A

United States Patent [19]

Prabhu

[11] Patent Number: 5,460,157

[45] Date of Patent: Oct. 24, 1995

[54] GAS FIRED CONVECTION OVEN

[75] Inventor: Gajanan M. Prabhu, Cary, N.C.

[73] Assignee: Southbend, A Middleby Company, Fuquay-Varina, N.C.

[21] Appl. No.: 145,293

[22] Filed: Oct. 29, 1993

Related U.S. Application Data

[63] Continuation of Ser. No. 833,889, Feb. 10, 1992, abandoned.

[51] Int. Cl.[6] ..... F24C 15/32; A21B 1/00

[52] U.S. Cl. ..... 126/21 A; 126/273 R; 431/354

[58] Field of Search ..... 126/21 R, 21 A, 126/1 D, 19 R, 19 A, 39 R, 273 R, 275 R, 110 R, 101, 116; 431/354, 286, 353; 432/176, 199

[56] References Cited

U.S. PATENT DOCUMENTS

| | | | |
|---|---|---|---|
| 3,140,706 | 7/1964 | Block et al. | 126/110 R |
| 3,831,579 | 8/1974 | Tamada | 126/21 A |
| 4,336,789 | 6/1982 | Ogawa | 126/21 A |
| 4,516,012 | 5/1985 | Smith et al. | 126/21 A |
| 4,757,800 | 7/1988 | Shei et al. | 126/21 A |
| 5,016,606 | 5/1991 | Himmel et al. | 126/21 A |
| 5,035,609 | 7/1991 | Riehl | 431/354 |
| 5,050,578 | 9/1991 | Luebke et al. | 126/21 A |
| 5,076,494 | 12/1991 | Ripka | 126/101 |
| 5,108,284 | 4/1992 | Gruswitz | 431/354 |
| 5,125,390 | 6/1992 | Riehl | 126/39 R |

FOREIGN PATENT DOCUMENTS

| | | | |
|---|---|---|---|
| 88541 | 5/1983 | Japan | 126/21 A |
| 136921 | 8/1983 | Japan | 126/21 A |
| 782678 | 9/1957 | United Kingdom | 126/21 R |

*Primary Examiner*—James C. Yeung
*Attorney, Agent, or Firm*—Rhodes, Coats & Bennett

[57] ABSTRACT

A convection oven is given a lower profile so that two ovens may be stacked without exceeding a height so that the uppermost of the stacked ovens may be comfortably reached by a relatively short person. Also, the oven requires less floor space for installation and operation. The height of the oven is reduced by placing inshot burners at an inlet to the oven. Heretofore, the burners were placed under the oven, which increased the space which must be provided to enclose the burner, and therefore the overall height of the burner. The height of the oven is reduced by allowing the flue gas flow from front to rear before entering the cooking cavity. Heretofore, the flue gas flowed from under the cooking cavity to the sides and up towards the top of the cooking cavity. From there, it traveled to the top of the cooking cavity before entering the cooking cavity itself.

8 Claims, 3 Drawing Sheets

GAS FIRED CONVECTION OVEN

This application is a continuation of application Ser. No. 07/833,889, filed Feb. 10, 1992, abandoned.

This invention relates to new and improved convection ovens and more particularly to convection ovens with improved burners for establishing a lower profile and a better air flow pattern.

Many current convection ovens use burners made of an elongated horizontal tube or tubes made of sheet metal or cast iron. Usually both of these types of burners require a relatively tall combustion chamber for two reasons. First, there must be enough space inside the combustion chamber for flames to rise vertically above the burner without damage to overlaying structures. Second, there must be enough space within the combustion chamber to house the elongated burner which may extend throughout the entire length or depth of the oven.

Because of the cost, size and mode of operation, tubular burners are usually located within a combustion chamber below a baking cavity within the oven. This location necessarily causes the burner skin temperature to increase to such a degree that the life of a sheet metal burner may be shortened. There may also be an adverse effect upon the bottom wall of the oven itself. Cast iron burners are more durable than sheet metal burners. However, they are also more expensive than sheet metal burners, and so make the oven more expensive for the consumer to buy.

The tubular type of burner also has a substantial effect upon the overall height of the oven which must be correspondingly tall in order to contain the relatively tall combustion chamber, especially with the need for flame space above the burner. This also means that when one oven is stacked on top of another, the top oven may be too high for some people to easily reach in.

Three examples of prior convection ovens are found in U.S. Pat. Nos. 4,516,012 (Smith et al.); 4,867,132 (Yencha); and 4,928,663 (Nevin et al.). Among other things, the differences between the inventive oven and the Smith et al. (4,516,012) oven and the Nevin et al. oven (4,928,663) are that, in the prior art ovens, the flue gas products are wiped around the outside of the oven cavity before being pulled into and after its exit from the oven cavity. Also, the inventive oven contains an inshot burner which does not require substantial flame space above it. The inventive oven is also different from Nevin et al. (4,928,663) because the impeller or blower wheel construction differs from the Nevin et al. impeller or blower wheel. Unlike the Smith et al. (4,516,012) oven and Nevin et al. oven (4,928,663), this improved flue gas flow allows for a reduced overall width of the inventive oven and overall height of the inventive oven by doing away with flue gas passageways on two sides and above the cooking cavity. The Yencha (4,867,132) oven has the burner in the back and not under the oven.

Accordingly, an object of the invention is to increase the burner life. A more particular object is to provide a burner which is used to heat the oven, while the burner itself remains outside of the combustion chamber thereby extending the burner's life.

Another object of the invention is to reduce the height of the oven. In particular, the object is to reduce the height of the oven by reducing the height of the combustion chamber and by reducing the space above the cooking cavity. Here, the object is to place the stacked oven in a double deck configuration at a convenient height for the workers, and especially for the shorter workers.

Yet another object of this invention is to reduce the width of the oven. In particular, the object is to reduce the width of the oven by improving the flue gas flow. Here the object is to reduce the floor space requirement in a kitchen for oven installation and operation.

These objects are possible because there is no tubular burner which must extend throughout the inside length or depth of the oven. Its absence allows the combustion chamber height to be reduced partially by the diameter, flame height, and perhaps more, of the old tubular burner.

Still another object of the invention is to reduce the overall oven height. Here an object is to make an uppermost one of the stacked ovens low enough so that it is easier for people to work with them.

In keeping with one aspect of this invention, an inshot burner is positioned outside a heating chamber. When it is ignited, its flame projects into the heating chamber. A bi-centrifugal blower, or any suitable air movement device, such as a blower or impeller, pulls flue gases through a passageway under and in the rear of the oven cavity, into the cooking cavity and also forces some of the heated air to circulate within the inside of the cooking cavity, and then out a flue gas passageway.

A preferred embodiment of this invention is shown in the drawings, in which.

Figure 1:
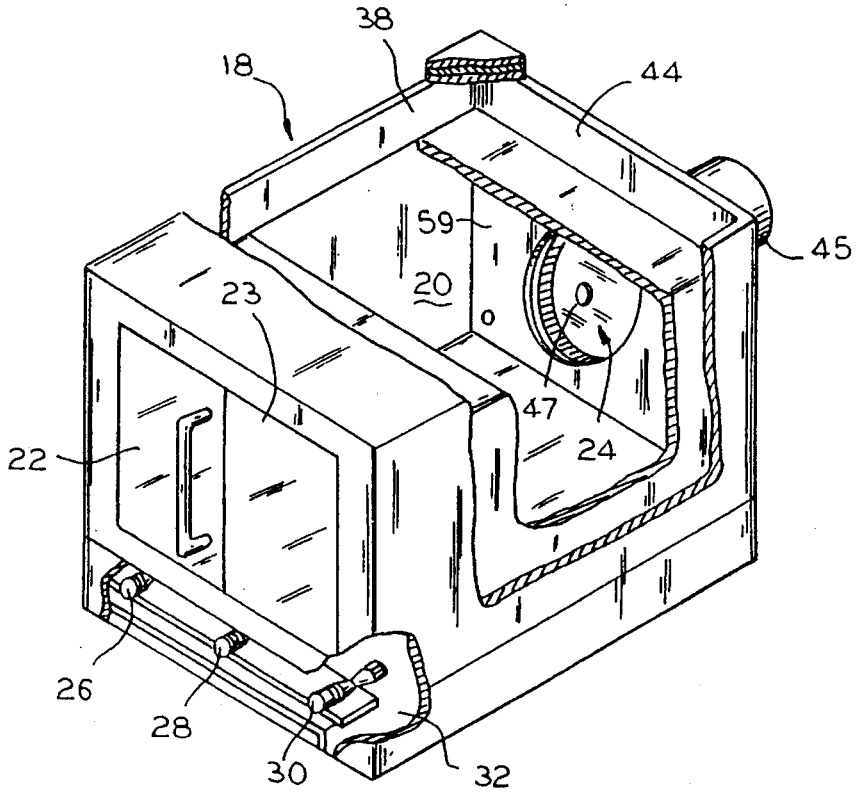
FIG. 1 is a perspective view of a convection oven, with parts of the outer and oven cavity walls cut away to reveal internal oven parts.
Figure 2:
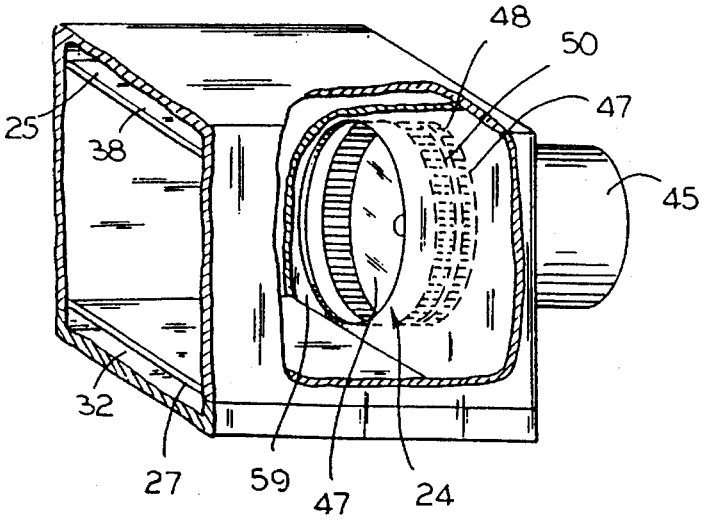
FIG. 2 is a perspective view partially cut away to show a bi-centrifugal blower.

As shown in FIG. 1, a low profile oven 18 comprises an insulated housing, defining a baking cavity 20 with 2 front access doors 22, 23 on one side and a blower 24 on another side. The oven housing may take any convenient form, shape, and size. It may have interior and exterior metal surfaces separated by suitable insulation.

Figure 8:
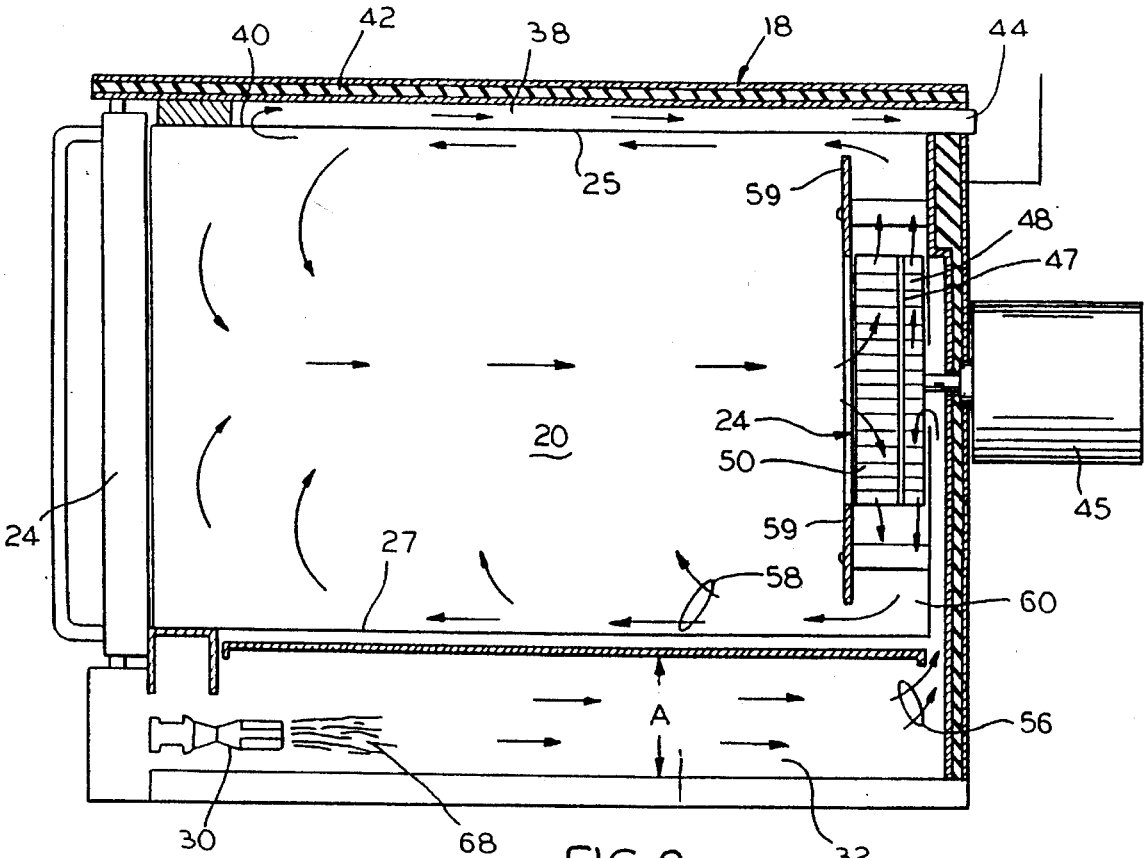
FIG. 8 is a cross sectional view showing the air circulation pattern within the oven.

In greater detail, the oven comprises an insulated enclosure housing 18 with a central baking area 20 defined on at least two sides by non-insulated walls 25, 27 (FIG. 8). On these two sides, channels 32, 38 form air passageways outside of the non-insulated walls. A first 32 of the channels is a combustion chamber formed under the floor of the oven cavity 20. A second 38 of the channels is an exhaust formed over the ceiling of the oven cavity 20. Each of these channels 32, 38 has an opening to ambient external air for drawing air into and expelling air from said oven cavity. The front of the exhaust passageway 38 opens into the baking cavity at inlet 40 (FIG. 8) and ends in the back of the oven at an outlet port 44. The blower 24 draws in air through one of the channels 32, circulates air within the oven, and blows air out through the other 38 of the channels. Inshot burners 26, 28, 30, at the front of the oven heat the air inside the first channel or combustion chamber 32.

The circulating air motor 45 is located outside the insulated housing of the oven cavity. Motor 45 drives bi-centrifugal blower 24, and circulates air within the oven and into exhaust passageway 38 through the outlet 40 to the ambient air through the outlet port 44.

The blower 24 comprises a rotating cylinder with a solid plate 47 in a central region. Blades 48 on rear side of the solid plate 47 draw ambient external air past the burner means 26, 28, 30 and into the oven chamber. Blades 50 on the front side of the solid plate 47 circulate air within the oven and expel it from the oven via channel 38. As the blower wheel rotates, a centrifugal force flings air outwardly from the periphery of the two sets of blades 48, 50, while drawing air into the center of the blades. The solid disk 47 separates these two air streams.

Hence, there are two separate air streams 56, 58 (FIG. 8), separated by a solid plate 47, one stream 56 entering the back of blower blades 48 and the other 58 entering the front blower blades 50. Air stream 58 is a recirculation of air within the oven cavity 20. Air stream 56 is the hot air that is heated by the burners 26–30. These two streams 56, 58 mix at the outlets of the two sets of blower blades.

The blower 24 is located behind a baffle plate 59 which separates the oven cavity into two compartments, one including blower 24 the other forming the oven baking cavity 20. The space surrounding baffle plate 59 and a hole through the center of baffle plate 59 provide a path through which the heated air may flow under the urging of the blower. The first or central opening provides a path for the passage of air from an interior of the oven to the blower. The baffle means 59 is surrounded by space between it and the oven walls. This space forms openings through which circulating air is expelled into the oven. Hence, the baffle plate 59 forces the air to flow around the sides of the oven and to return to the blower through the center of the oven. This flow creates a substantially uniform temperature throughout the oven cavity 20.

The oven area is heated from the draft 56 of hot air flowing through channel 32. More particularly, the blades 48 draw in a constant inflow of fresh air 56 which has been heated by the burners 26, 28, 30. This in flow forces an equal amount of internal oven air out the port 40 and through channel 38 over the top of the oven to exit port 44. This draft of air tends to prevent cooling air from entering the oven via port 44 and thus retains the heat in the oven.

Figure 9:
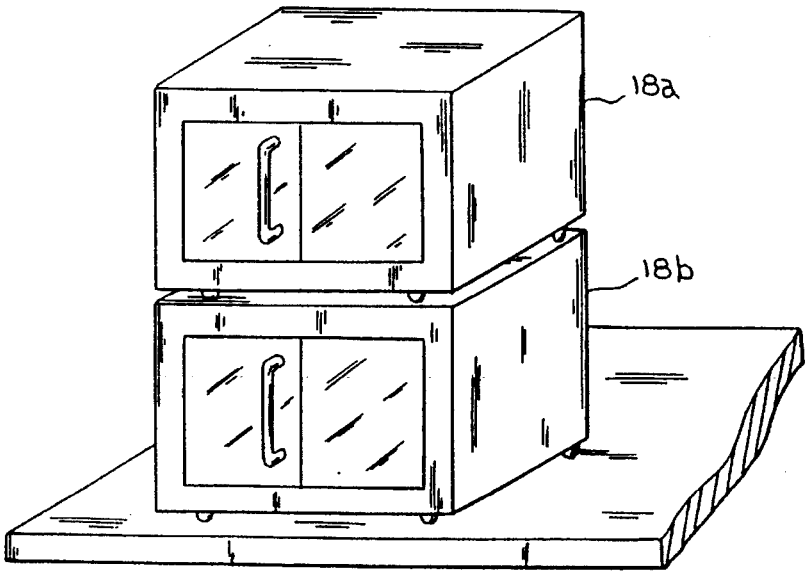
FIG. 9 shows two of the inventive ovens stacked one above the other.

Means is provided for maintaining the inshot burners 26, 28, 30 from the front of the oven since they are positioned at the front of the combustion chamber 32. By this, the overall height of the oven is reduced since the burners are not enclosed within a space below the oven cavity. In the prior art, these burners were often at the back of the oven or were under the oven. Among other things, when under the oven, a direct contact between a burner flame and the bottom surface 27 of the oven cavity 20 would soon warp, damage or destroy the oven. Therefore, when under the oven, the flame had to be far enough below the surface 27 to preclude such damage, which required a substantial height, at A. The invention greatly reduces this height. Thus, as shown in FIG. 9, the invention provides for a plurality of stackable, low profile ovens, with the burner means heating the air at an entrance of -not within-- the combustion chamber 32.

Figure 3:
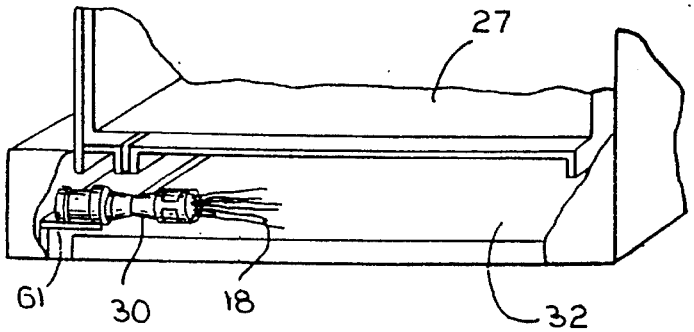
FIG. 3 is a perspective view, partially in cross section, to show an inshot burner in the new convection oven.

In keeping with one aspect of this invention, the traditional combustion tubular or cast iron burner is replaced by one or more modular inshot burners 26–30 (FIGS. 4–7). The inshot burners are located at a front of said oven for easy servicing and maintenance (FIGS. 1, 3, 8). Any suitable modules which are standard commercial items may be used. One suitable module is made by the Robertshaw Controls Company, New Stanton Division. Another supplier of suitable modules is Burner Systems International, Inc.

A transverse channel shaped support member 61 extends under and across the three burner modules. Each module is cradled in a concave shape 63 and secured in place by two screws 65, 67. The downwardly directed members of channel 61 rest on the floor of combustion chamber 32 and support the burners 26–30 in an elevated position.

Each of these modular burners has a somewhat cylindrical configuration and clips together with other modules to form an array of burners, in a horizontal row. These cylindrical members have somewhat wing-like projections 69 which provide means for feeding gas into adjacent modules as a lighting flame. A flame shaping means is located at the inner end of the cylindrical member to project a flame 68 into the combustion chamber or intake air channel 32. This flame 68 (FIG. 3) is somewhat reminiscent of a blowtorch flame. The heat from the flame is projected throughout the combustion chamber 32 and upwardly at 56 (FIG. 8) through the blower and into the oven area 20.

Figure 6:
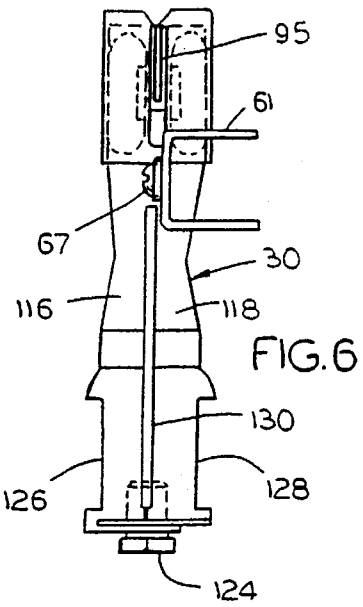
FIG. 6 is a side elevation of the inshot burner taken along line 6—6 of FIG. 4.
Figure 7:
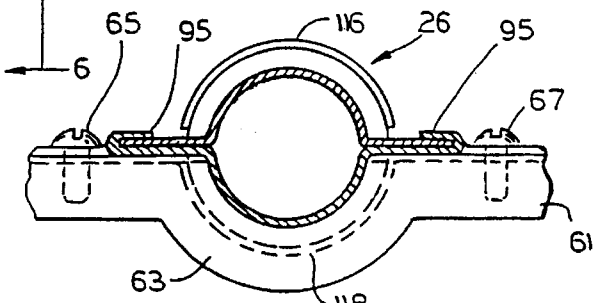
FIG. 7 is a cross sectional view taken along line 7—7 of FIG. 4.
Figure 5:
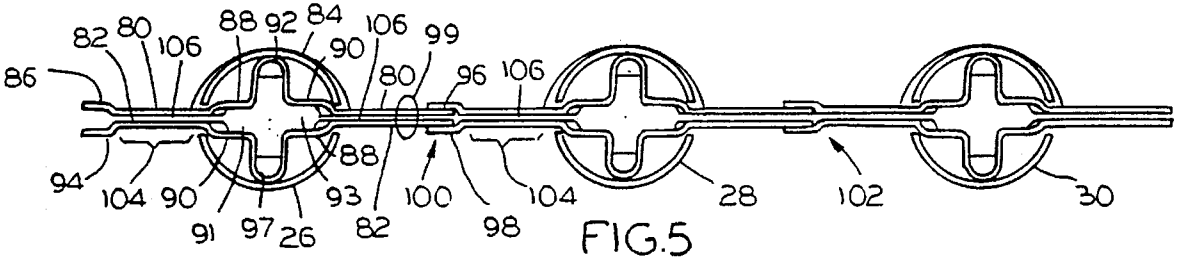
FIG. 5 is an end view of the inshot burner taken along line 5—5 of FIG. 4.
Figure 4:
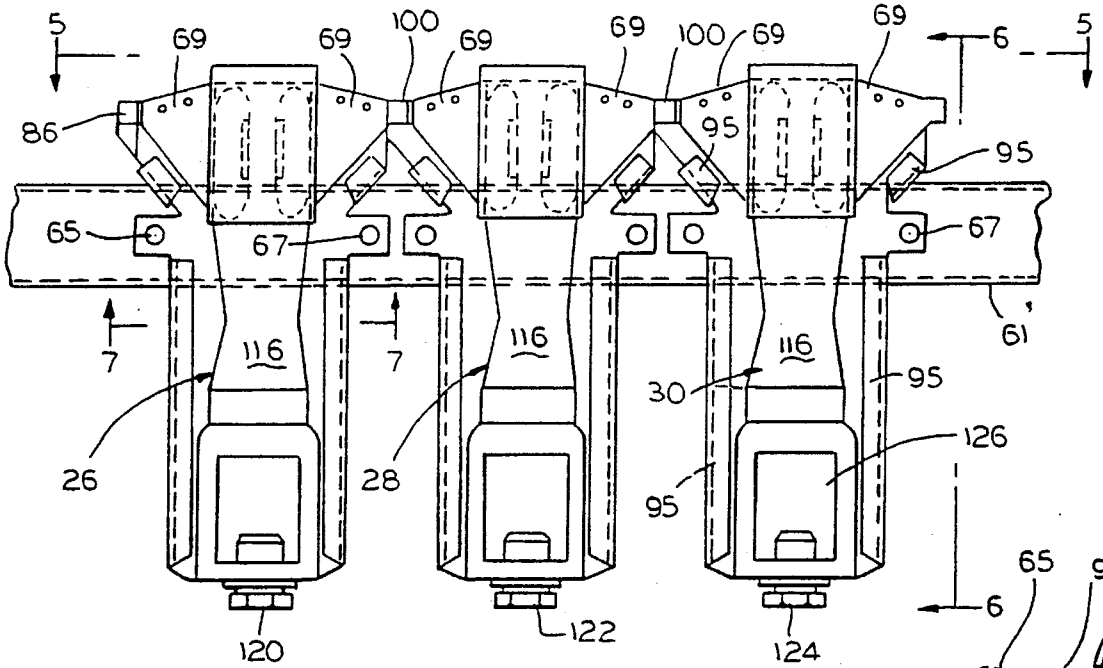
FIG. 4 is a top plan view of the inshot burners.

The construction of the inshot burners 26-30 is best seen in FIGS. 4–6. The burner is made of sheet metal, and therefore preserves the desirable low cost. However, since it is outside chamber 32, it remains cooler and the sheet metal does not discolor, warp, disintegrate or otherwise become damaged by the heat.

The in-shot burners are located in a horizontal row to project a plurality of horizontal flames into the first channel 32, which extends across substantially the full width of the oven. By way of example, modular burner 30 (FIGS. 5, 6) is made from two mirror image stamped metal plates 80, 82, surrounded by a somewhat cylindrical member 84. One of the stamped metal plates 80 begins with a step 86, followed by a substantially flat member 87 and then half 88 of a flame shaping channel 91 which is completed by a complementary shape 90 formed on plate 82. Thereafter plate 80 has a second flame shaping channel 92, followed by its half 90 of the channel 93 completed by shape 88 on plate 82. Thus, there are four substantially U-shaped members 91, 92, 93, 97, which together will tend to shape the flame in a known manner.

The other plate 82 is a mirror image of plate 80. Metal parts are crimped together as at 95. When those two plates are joined together in a face-to-face contact, the two steps 86, 94 form the open arms of a U-shaped member for receiving a tab 99 formed by the two flat face-to-face ends 96, 98 on the opposite ends of the two wing-like plates 80, 82. Therefore, as shown at 100, 102, the three modules 26, 28, 30 are formed by slipping the tabs 96, 98 on one end of wing-like plates 80, 82 into the U-shaped member 86, 94 on the opposite end of the plates. In the flat areas, such as 104, the two plates 80, 82 are separated by a narrow space which provide a continuous gas carry over channel 106 for conveying lighting gas to adjacent burners. The interlocking feature of tabs 96, 98 and U-shaped members 86, 94 thus enable the modules to snap together.

The generally cylindrical shroud, 116, 118, is given a shaped waist of reduced its cross section which enhances the burner efficiency. An orifice hood 120, 122,124 is placed in the end of the cylindrical shroud 116, 118 to receive gas from a manifold leading to a connecting gas line (not shown) and to provide an orifice for emitting gas into an area having upper and lower windows 126, 128 for admitting combustion air. A gas stream is projected forward of the orifice in the orifice hood, past windows 126, 128, and through the waist of reduced cross section at the center of the cylindrical shroud. The high velocity gas jet streaming from the orifice injects combustion air through the windows 126, 128. The gas and combustion air mix homogeneously as they pass through the diverging part of cylindrical shroud downstream of the reduced cross section. At the far end of the waist, the projected gas-air mixture reaches the flame shaping members 88–92.

If, for any reason, flames are burning at one or more of the burners and no flame is burning at another burner, the gas passageway 106 at the flat positions 104, extending through the connectors 100 act as a channel for lighting gas to re-ignite the burner which is out.

Thus, as shown in FIG. 8, substantially none of the height A is devoted to housing a burner, per se. Moreover, there is no need to provide a clearance above the flame of the non-existing burner. The only space that is required is devoted to the passage of a stream of hot air and to those special needs that are required to build the assembly and to provide a workable device.

Those who are skilled in the art will readily perceive how to modify the invention. Therefore, the appended claims are to be construed to cover all equivalent structures which fall within the true scope and spirit of the invention.

The claimed invention is:

1. A gas-fired convection oven, comprising:

(a) an insulated housing having a baking cavity and an access door on one side of the baking cavity;

(b) a horizontal combustion channel disposed under a floor of the baking cavity and communicating with the baking cavity, the combustion channel including a front end open to ambient external air;

(c) an exhaust channel disposed above the baking cavity and in communicating with the baking cavity for exhausting air from the baking cavity;

(d) a blower mounted within the insulated housing for drawing heated air into the baking cavity through the combustion channel circulating the heated air in the baking cavity, and expelling air through the exhaust channel; and (e) at least one inshot gas burner horizontally mounted adjacent to the open front end of the combustion channel, each inshot burner including (i) an air inlet at one end of the inshot burner, the air inlet being disposed external to the combustion channel for drawing cool ambient air into the inshot burner to mix with a gas stream for eventual burning, and (ii) flame projecting means at an opposite end of the inshot burner, the flame projecting means disposed near the front end of the combustion channel for projecting a flame into the combustion channel.

2. The gas-fired convection oven of claim 1 including a plurality of inshot gas burners arranged in a horizontal row.

3. The gas-fired convection oven of claim 1 further including a baffle for separating the baking cavity into two compartments, one of the compartments containing the blower, the other of the compartments forming the baking cavity.

4. The gas-fired convection oven of claim 1 wherein the exhaust channel is disposed horizontally above the baking cavity with one end of the exhaust channel on a side of the baking cavity opposite the blower.

5. A low profile, gas-fired convection oven, comprising:

(a) an insulated housing having a baking cavity and an access door on one side of the baking cavity;

(b) a horizontal combustion channel disposed under a floor of the baking cavity, the combustion channel including a front end open to ambient external air and a back end open to the baking cavity;

(c) a horizontal exhaust channel disposed above the baking cavity, the exhaust channel including a first end open to the baking cavity and a second end open to ambient external air;

(d) a blower mounted inside the baking cavity for drawing heated air into the baking cavity from the combustion channel, circulating the heated air in the baking cavity, and expelling air through the exhaust channel; and (e) at least one cylindrical inshot gas burner horizontally mounted adjacent to the open front end of the combustion channel, the inshot burner including (i) gas inlet means on one end of the inshot burner for delivering gas to the inshot burner, (ii) an air inlet window at the same end of the inshot burner as the gas inlet means, the air inlet window being disposed external to the combustion channel for drawing unheated ambient air into the inshot burner to mix with a gas stream, and (iii) flame-shaping means at an opposite end of the inshot burner from the air inlet window and the gas inlet means, the flame-shaping means extending into the open front end of the combustion channel for projecting a blowtorch-like flame into the combustion channel.

6. The low profile, gas-fired convection oven of claim 5 including a plurality of inshot gas burners arranged in a horizontal row to project a plurality of horizontal flames into the combustion channel.

7. The low profile, gas-fired convection oven of claim 6 further including a baffle for separating the baking cavity into two compartments, one of the compartments containing the blower and the other of the compartments forming the baking cavity, the baffle including:

(a) a central opening for providing a path for the passage of air from the baking cavity to the blower; and (b) a peripheral opening surrounding the baffle through which circulating air is expelled from the blower back into the baking cavity.

8. The low profile, gas-fired convection oven of claim 7 wherein the first end of the exhaust channel is disposed on a front side of the baking cavity, and the second end of the exhaust channel is disposed on a back side of the oven.

* * * * *